US008457526B2

(12) United States Patent
Takagi

(10) Patent No.: US 8,457,526 B2
(45) Date of Patent: Jun. 4, 2013

(54) IMAGE FORMING APPARATUS HAVING A SHEET CONVEYANCE PATH INCLUDING A LINEAR PATH TO AN IMAGE FORMING PORTION

(75) Inventor: Masaru Takagi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 567 days.

(21) Appl. No.: 12/693,734

(22) Filed: Jan. 26, 2010

(65) Prior Publication Data

US 2010/0194027 A1 Aug. 5, 2010

(30) Foreign Application Priority Data

Jan. 30, 2009 (JP) ..... 2009-018928
Jan. 30, 2009 (JP) ..... 2009-018984

(51) Int. Cl.
*G03G 21/00* (2006.01)
*B65H 29/00* (2006.01)
*B65H 5/02* (2006.01)

(52) U.S. Cl.
USPC ..... 399/124; 271/186; 271/273

(58) Field of Classification Search
USPC ..... 399/124, 272, 273
See application file for complete search history.

(56) References Cited

U.S. PATENT DOCUMENTS 6,145,828 A * 11/2000 Arai ..... 271/3.03
6,526,255 B2 2/2003 Itoh et al.
7,168,701 B2 * 1/2007 Isaka et al. ..... 271/273

FOREIGN PATENT DOCUMENTS

| | | |
|---|---|---|
| JP | 10-26857 | 1/1998 |
| JP | 2000-229745 | 8/2000 |
| JP | 2005-315920 | 11/2005 |
| JP | 2007-22687 | 2/2007 |
| JP | 2007-217126 | 8/2007 |
| JP | 2007-279535 | 10/2007 |

* cited by examiner

*Primary Examiner* — David Gray
*Assistant Examiner* — Andrew Do
(74) *Attorney, Agent, or Firm* — Smith, Gambrell & Russell, LLP

(57) ABSTRACT

An image forming apparatus includes a sheet storage portion, an image forming portion, a sheet ejector, a sheet-reversing unit, first to fourth conveying paths, and a two-sided conveyance unit. The fourth conveying path includes a linear path formed between two conveyance guides constituting the two-sided conveyance unit. The two-sided conveyance unit is supported in a slidable manner along a slider provided to an apparatus main body. One of the two conveyance guides is made of a flat guide plate and is supported in such a manner that it can be opened or closed with respect to the other conveyance guide.

9 Claims, 12 Drawing Sheets

IMAGE FORMING APPARATUS HAVING A SHEET CONVEYANCE PATH INCLUDING A LINEAR PATH TO AN IMAGE FORMING PORTION

CROSS-REFERENCE TO RELATED APPLICATIONS

This application is based on Japanese Patent Applications No. 2009-018928 and No. 2009-018984 filed on Jan. 30, 2009, the entire contents of which are hereby incorporated by reference.

BACKGROUND OF THE INVENTION

1. Field of the Invention

The present invention relates to an image forming apparatus which can form images on both sides of a paper sheet.

2. Description of Related Art

There is a type of image forming apparatus such as a copier, a printer, a facsimile, or a multifunction apparatus, which can form images by an electrophotographic method on both sides of a paper sheet (e.g., see JP-A-10-026857, JP-A-2005-315920 and JP-A-2007-217126).

This type of image forming apparatus includes a sheet storage portion for storing paper sheets, an image forming portion for forming images on the paper sheet fed from the sheet storage portion, a sheet ejector for delivering the paper sheet externally after the image forming portion forms images on one side or both sides of the paper sheet, a sheet-reversing unit for reversing sides of the paper sheet after the image forming portion forms images on one side of the paper sheet, a first conveying path from the sheet storage portion to the image forming portion, a second conveying path from the image forming portion to the sheet ejector, a third conveying path which branches from the second conveying path and reaches the sheet-reversing unit, and a fourth conveying path which extends from the sheet-reversing unit and joins the first conveying path.

When the image forming apparatus having the above-described structure forms image on both sides of the paper sheet, the paper sheet fed from the sheet storage portion passes through the first conveying path and is supplied to the image forming portion, so that the image forming portion forms images on one side (first side). This paper sheet with images formed on one side passes through the second conveying path and the third conveying path so as to be led to the sheet-reversing unit, which reverses sides of the paper sheet. After that, the paper sheet passes through the fourth conveying path and is led back to the first conveying path. This paper sheet that is led back to the first conveying path after the sides thereof are reversed is supplied again to the image forming portion, so that images are formed on the opposite side (second side opposite to the side on which the images are formed in the first time). The paper sheet with images formed on both sides is delivered externally from the second conveying path by the sheet ejector.

This type of image forming apparatus has a structure for opening a conveyance guide to release the fourth conveying path so that a jammed paper sheet can easily be removed if jamming of the paper sheet occurs while the paper sheet with images formed on one side passes through the fourth conveying path to be led back to the first conveying path (e.g., see JP-A-2005-315920).

In particular, a high speed apparatus conveys two or more paper sheets continuously in the fourth conveying path that is a two-sided conveyance path, and it adopts a structure of opening a large conveyance guide to release the fourth conveying path so that jammed paper sheets can be removed at one time if jamming of two or more paper sheets occurs in the fourth conveying path. In this structure, it is desirable that the jammed paper sheet in the two-sided conveyance path can be removed easily. Further, it is desirable if the structure of the conveyance guide can be simplified for cost reduction.

In addition, when the two-sided printing of a plurality of sheets are performed, image forming on the paper sheet supplied from the sheet storage portion and printing on the back side (second side) of the paper sheet conveyed from the two-sided conveyance path are performed alternately from a mid-point of the printing job. The paper sheet with images printed on one side is temporarily in a standby state in the fourth conveying path. In this case, if the paper sheet is in the standby state in a curved portion of the conveying path or the like, the paper sheet may be curled. Therefore, it is necessary to adopt a structure in which the paper sheet can be in the standby state without being curled in the fourth conveying path.

SUMMARY OF THE INVENTION

The present invention is created for solving the above-described problem, and it is an object of the present invention to provide an image forming apparatus in which jammed paper sheets can be removed easily with a simple structure of the conveyance guide in the two-sided conveyance path, and an occurrence of a curled paper sheet in the standby state in the two-sided conveyance path can be prevented.

An image forming apparatus of the present invention includes a sheet storage portion for housing paper sheets, an image forming portion for forming images on a paper sheet fed from the sheet storage portion, a sheet ejector for ejecting paper sheets with images formed on one side or on both sides by the image forming portion, a sheet-reversing unit for reversing sides of the paper sheet with images formed on one side by the image forming portion, a first conveying path from the sheet storage portion to the image forming portion, a second conveying path from the image forming portion to the sheet ejector, a third conveying path branching from the second conveying path so as to reach the sheet-reversing unit, a fourth conveying path extending from the sheet-reversing unit so as to join the first conveying path, and a two-sided conveyance unit having the sheet-reversing unit and the fourth conveying path. Further, the fourth conveying path includes a linear path formed between two conveyance guides constituting the two-sided conveyance unit, the two-sided conveyance unit is supported in a slidable manner along a slider provided to an apparatus main body, and one of the two conveyance guides is made of a flat guide plate forming the linear path and is supported in such a manner that it can be opened or closed with respect to the other conveyance guide.

The above-described and other objects and features of the present invention will be more apparent from the following description of preferred embodiments with reference to the attached drawings as noted below.

DETAILED DESCRIPTION OF THE PREFERRED EMBODIMENTS

Hereinafter, an embodiment of the present invention will be described with reference to the attached drawings.

Figure 1:
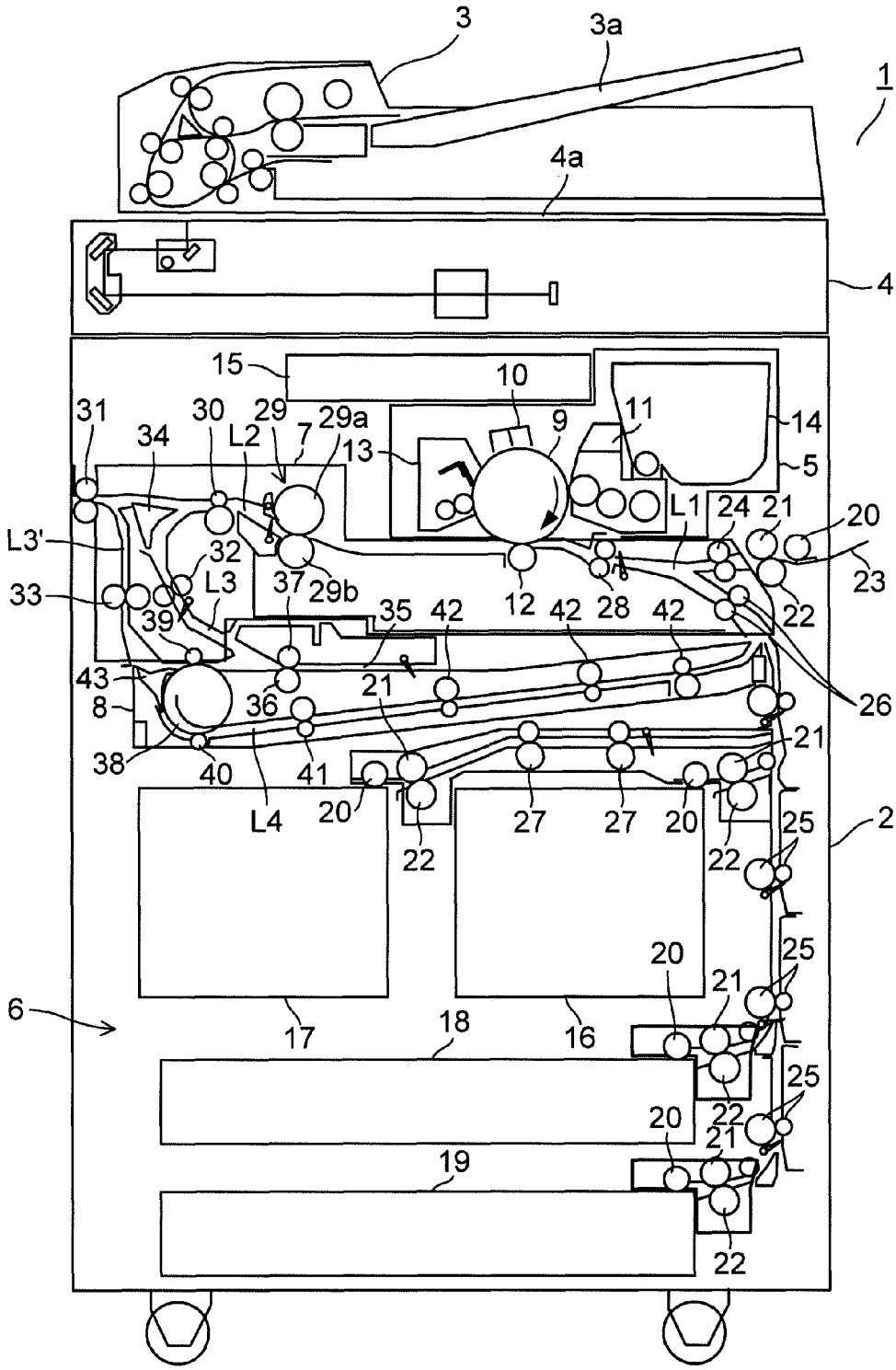
FIG. 1 is a cross section of an image forming apparatus (multifunction apparatus) according to an embodiment of the present invention.

FIG. 1 is a cross section of an image forming apparatus according to an embodiment of the present invention. The image forming apparatus 1 is a multifunction apparatus combining a copier function, a printer function and a facsimile function, which can form images on both sides of a paper sheet. This image forming apparatus 1 includes an apparatus main body 2, and an automatic document feeder 3 and a document reader 4 which are disposed at the upper portion of the apparatus main body 2. An image forming portion 5 is disposed at the upper portion inside the apparatus main body 2, and a sheet storage portion 6 is disposed at the lower portion inside the apparatus main body 2. In addition, a transfer conveyance unit 7 and a two-sided conveyance unit 8 are disposed between the image forming portion 5 and the sheet storage portion 6 inside the apparatus main body 2. The transfer conveyance unit 7 is provided with a reverse roller 36 and a reverse follower roller 37 constituting the sheet-reversing unit.

The image forming portion 5, which forms images by the electrophotographic method, includes a photosensitive drum 9 as an image carrier that is disposed in a rotatable manner, and a charger 10, a developing device 11, a transfer roller 12 and a cleaning device 13 which are disposed around the photosensitive drum 9, and a toner hopper 14 for supplying toner as developer to the developing device 11. Note that a laser scanner unit (LSU) 15 as a scanning optical unit is disposed beside the image forming portion 5.

The sheet storage portion 6 includes four detachable sheet feed cassettes 16, 17, 18 and 19 in each of which a plurality of paper sheets are stacked and housed. Close to each of the sheet feed cassettes 16 to 19, there are provided a pick roller 20 for picking a paper sheet one by one from one of the sheet feed cassette 16 to 19, and a feed roller 21 and a retard roller 22 for separating the picked paper sheet from others and sending out the same. In addition, close to a bypath tray 23, there are provided a pick roller 20, a feed roller 21, a retard roller 22 and a conveyance roller 24 as a bypath conveyance unit. Note that numerals 25, 26 and 27 denote conveyance rollers in FIG. 1.

The transfer conveyance unit 7 conveys a paper sheet sent out from the sheet storage portion 6 to the image forming portion 5 at an appropriate timing and delivers a paper sheet with images formed by the image forming portion 5 to a paper output tray (not shown). This transfer conveyance unit 7 includes a resist roller 28 disposed in a first conveying path L1 from the sheet storage portion 6 to the image forming portion 5, the transfer roller 12, a fixing device 29 and a conveyance roller 30 disposed in a second conveying path L2 from the image forming portion 5 to a paper output roller 31 that will be described later as a sheet ejector, and the paper output roller 31. Here, the fixing device 29 includes a fixing roller 29*a* and a pressing roller 29*b* that are rotated in a pressed state to each other.

In addition, the transfer conveyance unit 7 is detachably attached to the apparatus main body 2. The transfer conveyance unit 7 is provided with a third conveying path L3 having a horizontal U-shaped branching from the second conveying path L2 to the reverse roller 36 and the reverse follower roller 37 of the two-sided conveyance unit 8, and a conveyance roller 32 is disposed at a midpoint of the third conveying path L3. In addition, the transfer conveyance unit 7 is provided with a reverse conveying path L3' that branches from the second conveying path L2 separately from the third conveying path L3 and extends downward, and a conveyance roller 33 is disposed at a midpoint of the reverse conveying path L3'. Further, at a branch portion between the second conveying path L2 and the third conveying path L3, there is provided a flapper 34 for changing a conveyance direction of the paper sheet.

The two-sided conveyance unit 8 is used for reversing sides of the paper sheet with images formed by the image forming portion 5, and includes an intermediate tray 35 connected to the third conveying path L3 and the reverse conveying path L3', and a fourth conveying path L4 disposed below the intermediate tray 35. The intermediate tray 35 is provided with a reverse roller 36 that can rotate in both directions and a reverse follower roller 37 that is pressed to or separated from the reverse roller 36.

In addition, the two-sided conveyance unit 8 is provided with a large sheet refeed roller 38 in a rotatable manner, and small rollers 39 and 40 that are pressed to the outer surface of the sheet refeed roller 38 in a rotatable manner. Note that the sheet refeed roller 38 is provided with a one-way clutch (not shown). Further, the fourth conveying path L4 extends from the reverse roller 36 and the reverse follower roller 37 constituting the sheet-reversing unit, and the fourth conveying path L4 joins the first conveying path L1.

In the fourth conveying path L4, there are disposed three sets of a conveyance roller 42 and a conveyance follower roller 41 which are pressed to each other, along the sheet conveyance direction. In addition, close to the sheet refeed roller 38, there is disposed a flapper 43 in a rotatable manner for changing a conveyance direction of the paper sheet that is temporarily drawn in onto the intermediate tray 35.

Note that the fourth conveying path L4 of the two-sided conveyance unit 8 in this embodiment has two or more paper sheet holding positions that can hold two or more paper sheets. Further, the two-sided conveyance unit 8 is provided with a conveyance guide (lower conveyance guide 8B) that constitutes a part of the fourth conveying path L4 and can open the fourth conveying path L4, in such a manner that it can be opened or closed. The conveyance follower rollers 41 are mounted on the conveyance guide in a rotatable manner. Note that details of the two-sided conveyance unit 8 will be described later.

Next, an image forming operation of the image forming apparatus 1 will be described.

For instance, when a document set on a document tray 3*a* of the automatic document feeder 3 is automatically conveyed to a contact glass 4*a* as a document reading portion so that an image of the document is optically read by the document reader 4, the photosensitive drum 9 in the image forming portion 5 is driven by a drive unit (not shown) to rotate in the arrow direction in FIG. 1 (in the clockwise direction), and the surface thereof is uniformly charged to be a predetermined potential by the charger 10. Then, a laser beam controlled based on image data sent from the document reader 4 is emitted from the laser scanner unit 15 and is projected onto the photosensitive drum 9, so that an electrostatic latent image is formed on the photosensitive drum 9. Then, the electrostatic latent image formed on the photosensitive drum 9 is developed by the developing device 11 with toner so as to be visualized as a toner image.

When paper sheets are fed from the cassette, paper sheets housed in e.g., the sheet feed cassette 16 of the sheet storage portion 6 are picked up by the pick roller 20 from the top one by one, and is separated by the feed roller 21 and the retard roller 22 one by one, and then is conveyed by the conveyance rollers 25 and 26 to the resist roller 28 through the first conveying path L1. Then, the paper sheet is in the standby state by the resist roller 28 and is then fed to the image forming portion 5 at a predetermined timing in synchronization with the toner image on the photosensitive drum 9.

In the image forming portion 5, the paper sheet supplied to a transfer nip between the photosensitive drum 9 and the transfer roller 12 is conveyed while being pressed by the transfer roller 12 to the photosensitive drum 9, so that the toner image on the photosensitive drum 9 is transferred onto the surface (first side) of the paper sheet. Then, the paper sheet with the transferred toner image is conveyed to the fixing device 29. When the paper sheet passes through the fixing nip between the fixing roller 29*a* and the pressing roller 29*b* of the fixing device 29, it is heated and pressed so that the toner image is fixed. Note that toner remaining on the surface of the photosensitive drum 9 (transfer residual toner) after the toner image is transferred onto the paper sheet is removed by the cleaning device 13.

Thus, if a face up output (FU output) is selected, the paper sheet with the toner image fixed on the surface by the fixing device 29 is conveyed to the paper output roller 31 through the second conveying path L2 as it is, in accordance with the conveyance direction decided by the flapper 34, and the paper sheet is delivered by the paper output roller 31 to the paper output tray (not shown) with the image side facing up.

On the other hand, if a face down output (FD output) or a two-sided image mode is selected, the flapper 34 switches the conveyance direction of the paper sheet. The paper sheet after passing through the fixing device 29 passes through the third conveying path L3 of the horizontal U-shaped and is conveyed to the two-sided conveyance unit 8.

In the two-sided conveyance unit 8, the reverse follower roller 37 is in a standby state apart from the reverse roller 36. When the paper sheet is conveyed to the two-sided conveyance unit 8 more than a predetermined length, the reverse follower roller 37 is pressed to the reverse roller 36. When the reverse follower roller 37 is pressed to the reverse roller 36 in this way, the reverse roller 36 is driven to rotate in the normal direction so that the paper sheet is drawn in the same direction. When the paper sheet is drawn in more than a predetermined length, the reverse roller 36 is reversed so that the paper sheet is switched back and conveyed to the reverse conveying path L3' or the fourth conveying path L4.

Specifically, if the face down output is selected, the flapper 43 changes the conveyance direction of the paper sheet to the reverse conveying path L3', and the paper sheet is delivered by the paper output roller 31 to the paper output tray (not shown) with the image side facing down.

In addition, if the two-sided image mode is selected, the flapper 43 changes the conveyance direction of the paper sheet to the fourth conveying path L4. Thus, the paper sheet is conveyed by the sheet refeed roller 38, the reverse follower roller 41 and the conveyance roller 42 in the fourth conveying path L4 with the image side facing up. Being conveyed from the fourth conveying path L4 to the first conveying path L1, the paper sheet is reversed and sent to the resist roller 28 with the image side facing down. Then, a toner image is formed on the opposite side (second side) of the paper sheet by the same process described above. The toner image on the paper sheet is fixed by the fixing device 29, and then the paper sheet is delivered to the paper output tray (not shown) by the paper output roller pair 31. Thus, images are formed on both sides of the paper sheet.

Note that the case where paper sheets are fed from the cassette is described above. If the paper sheets are fed manually, the paper sheets set on the bypath tray 23 are picked up by the pick roller 20 one by one from the top sheet, which is separated from the other by the feed roller 21 and the retard roller 22 and is conveyed by the conveyance roller 24 to the resist roller 28 through the first conveying path L1. After that, an image is formed on the paper sheet by the same process as described above.

Next, details of the two-sided conveyance unit 8 will be described with reference to FIGS. 2 to 8.

Figure 2:
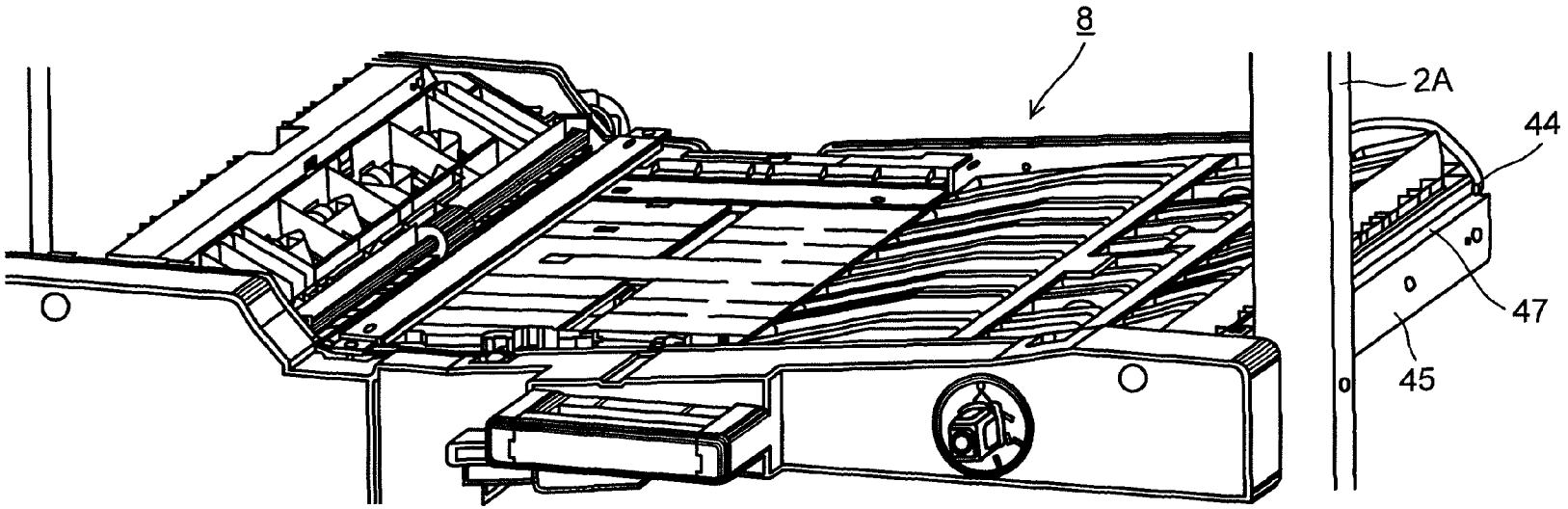
FIG. 2 is a perspective view of a two-sided conveyance unit of the image forming apparatus.
Figure 3:
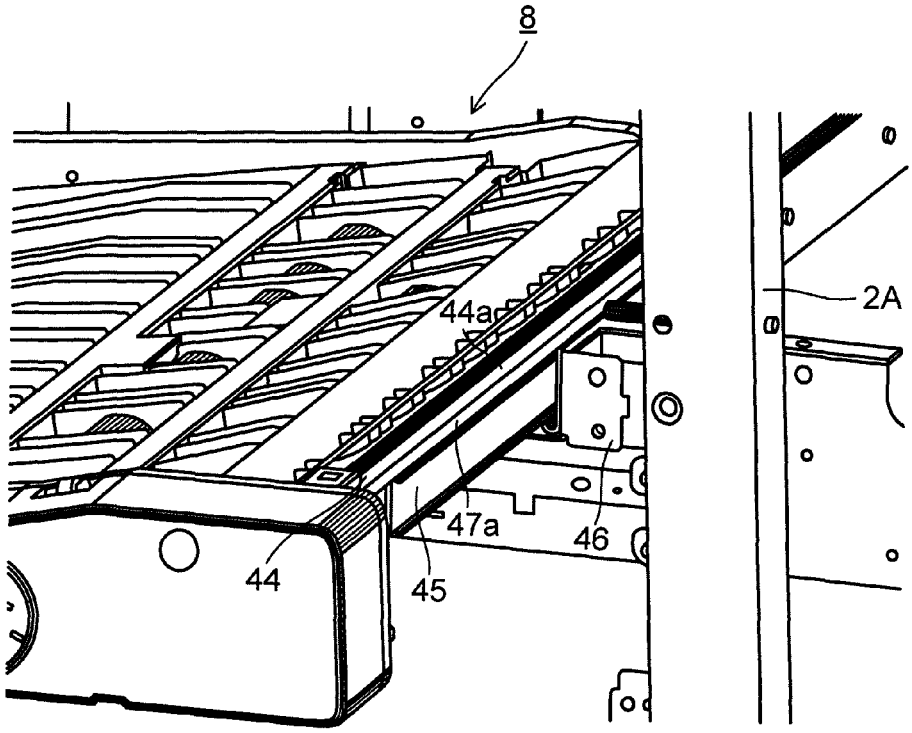
FIG. 3 is a partial perspective view illustrating the two-sided conveyance unit drawn out from the image forming apparatus.
Figure 4:
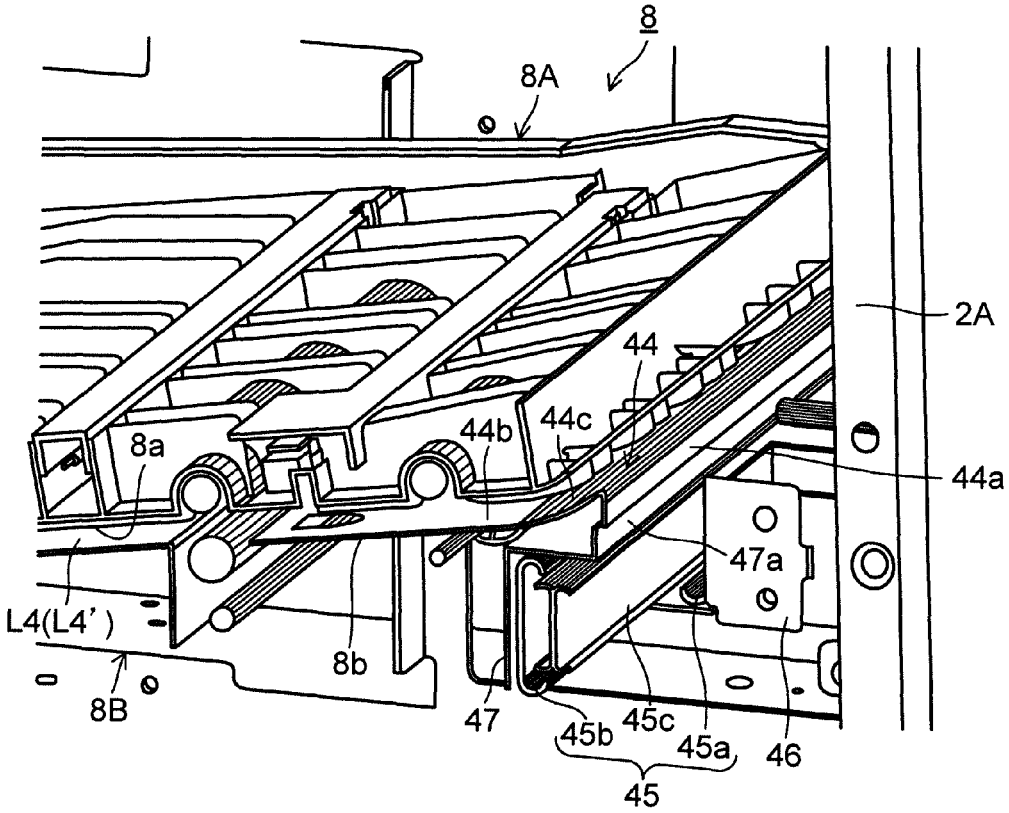
FIG. 4 is a cutaway perspective view of a joining guide of the two-sided conveyance unit.
Figure 5:
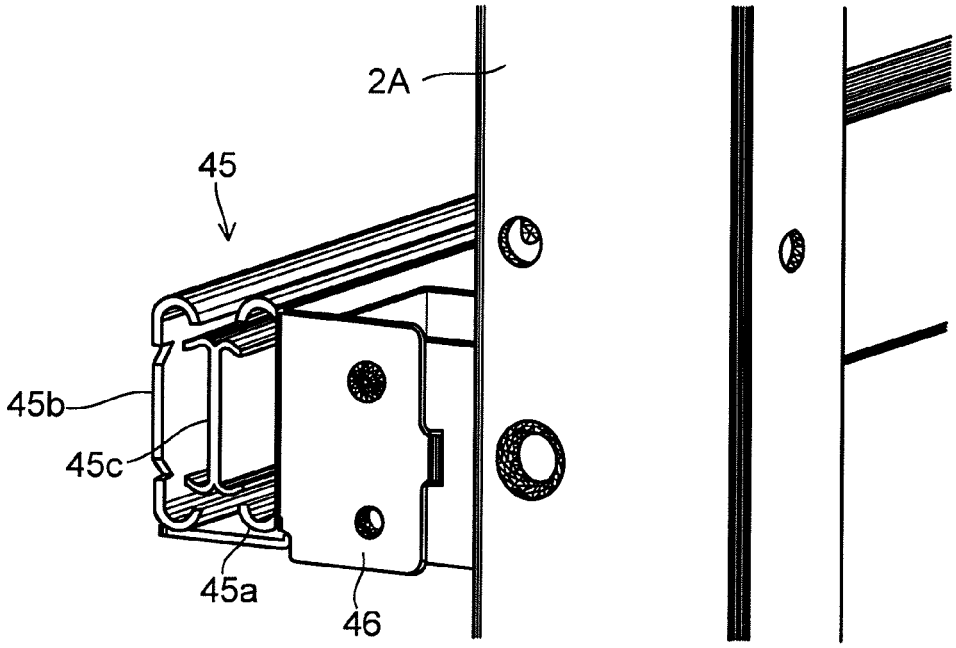
FIG. 5 is a perspective view of a slider of the image forming apparatus.
Figure 6:
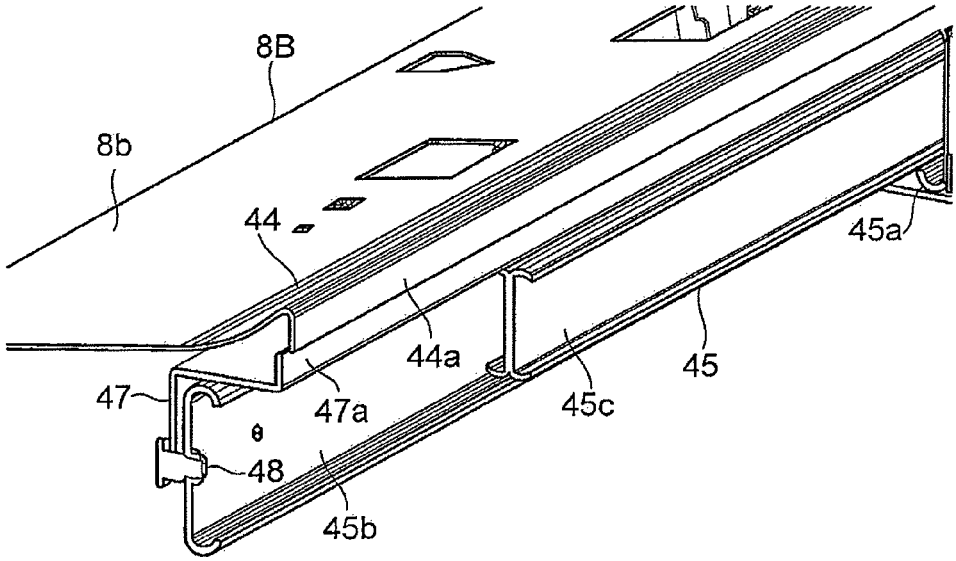
FIG. 6 is a partial section perspective view illustrating a fixing structure of the joining guide.
Figure 7:
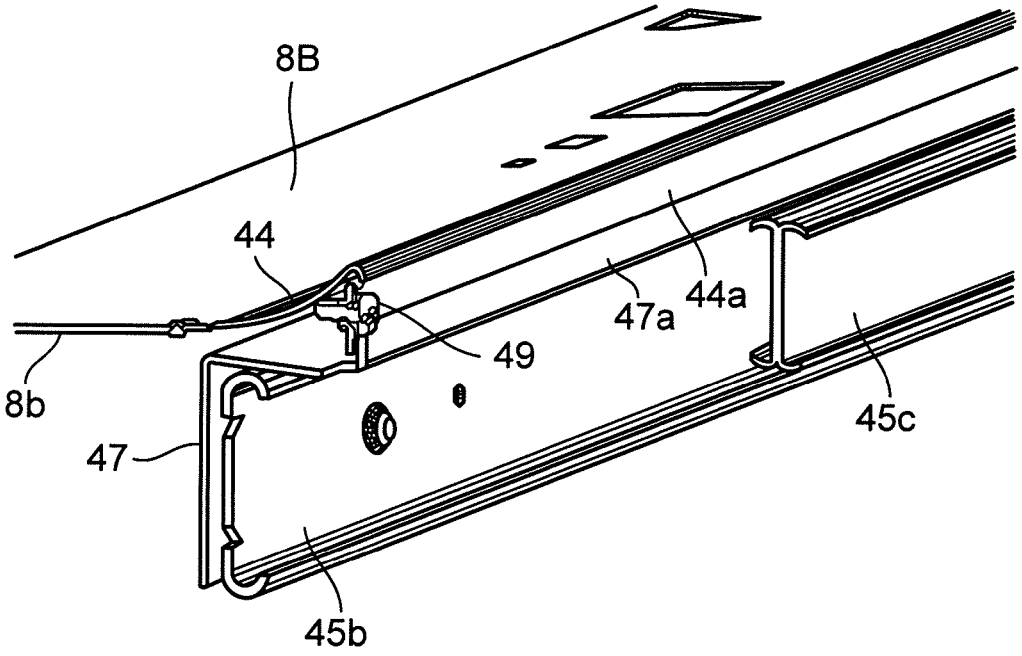
FIG. 7 is a partial section perspective view illustrating a fixing structure of the joining guide.
Figure 8:
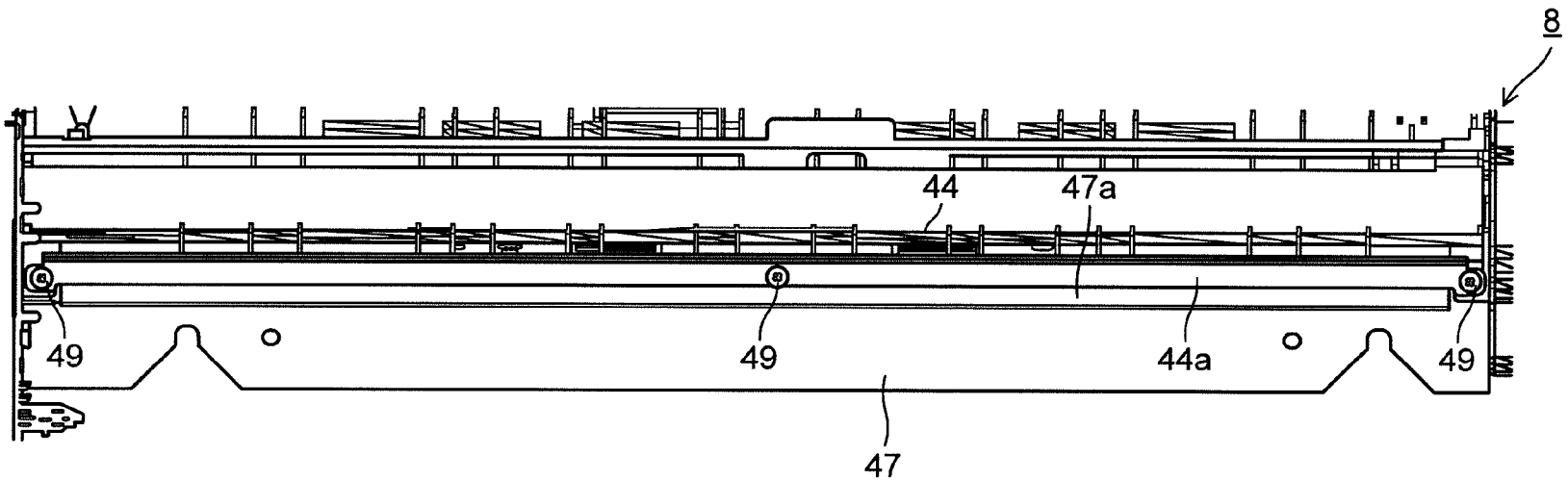
FIG. 8 is a front view illustrating the fixing structure of the joining guide to a fixing member.

FIG. 2 is a perspective view of the two-sided conveyance unit, FIG. 3 is a partial perspective view illustrating a state the two-sided conveyance unit drawn out from the image forming apparatus, FIG. 4 is a cutaway perspective view of a joining guide of the two-sided conveyance unit, FIG. 5 is a perspective view of a slider, FIGS. 6 and 7 are partial section perspective views illustrating a fixing structure of the joining guide, and FIG. 8 is a front view illustrating the fixing structure of the joining guide to a fixing member.

As illustrated in FIG. 4, the two-sided conveyance unit 8 is provided with the fourth conveying path L4 (particularly, a linear path L4') as the two-sided conveying path formed between an upper conveyance guide 8A and the lower conveyance guide 8B. Specifically, a guide plate 8*a* made of a metal sheet constituting the lower surface of the upper conveyance guide 8A and a guide plate 8*b* made of a metal sheet constituting the upper surface of the lower conveyance guide 8B form the fourth conveying path L4 (particularly, the linear path L4').

The fourth conveying path L4 extends linearly and little inclined upward from the downstream outlet of the sheet refeed roller 38 to the joining guide 44, and the lower surface of the conveying path in the section is made of the lower conveyance guide 8B. Note that the above-described linear path of the fourth conveying path L4 is the linear path L4'.

At the joining portion of the guide plate 8*b* with the first conveying path L1 on the downstream end in the paper sheet conveyance direction, there is formed the joining guide 44 that is curved upward like an arc. Further, a guide end (rear end) 44*a* of the joining guide 44 is bent downward vertically. The guide surface of the joining guide 44 is constituted of a linear guide portion 44*b* (linear portion) and a curved guide portion 44*c* (curved portion). The linear guide portion 44*b* is adjacent to the downstream end in the sheet conveyance direction of the guide plate 8*b* of the lower conveyance guide 8B and extends along the extension line of the fourth conveying path L4 (particularly, the linear path L4') in the conveyance direction. The curved guide portion 44*c* extends continuously from the linear guide portion 44*b* to the downstream side in the sheet conveyance direction so as to curve upward and guides the conveyance direction of the paper sheet to approach the conveyance direction of the first conveying path L1. Therefore, a thrusting force acts on the linear guide portion 44*b* and the curved guide portion 44*c* of the joining guide 44 in accordance with stiffness of the paper sheet when the paper sheet passes through the portions. It can be said that the guide end 44*a* is formed by bending the end portion of the curved guide portion 44*c* opposite to the linear guide portion 44*b* outward (downward vertically).

The two-sided conveyance unit 8 illustrated in FIG. 2 is supported at the upstream end and the downstream end (joining end) in the sheet conveyance direction by sliders 45 (one of which is illustrated in FIG. 2) provided to the apparatus main body 2 in a slidable manner in the width direction (perpendicular to the sheet conveyance direction). Thus, if necessary, the two-sided conveyance unit 8 can be drawn out by sliding it along the slider 45 as illustrated in FIG. 3.

Here, the slider 45 is constituted of a fixed guide 45*a* having an inverted C-shaped cross section, a movable guide 45*b* having a C-shaped cross section and a guide rail 45*c* as illustrated in FIG. 5. The fixed guide 45*a* is fixed to a frame 2A of the apparatus main body 2 via a bracket 46. The movable guide 45*b* is fixed to the two-sided conveyance unit 8. The guide rail 45*c* is retained by the fixed guide 45*a* and the movable guide 45*b* via balls (not shown) in a slidable manner.

Thus, in this embodiment, as illustrated in FIGS. 4, 6 and 7, a fixing member 47 having a Z-shaped cross section, which constitutes a part of the frame of the two-sided conveyance unit 8, is fixed to the movable guide 45*b* of the slider 45 with a plurality of screws 48 (one of which is illustrated in FIG. 6). Then, a flange portion 47*a* provided to the upper surface of the fixing member 47 perpendicularly is arranged to overlap with the inner surface of the vertical guide end 44*a* of the joining guide 44. The vertical guide end 44*a* of the joining guide 44 is fixed to the flange portion 47*a* of the fixing member 47 with screws 49 at three positions of both ends and the center in the width direction as illustrated in FIGS. 7 and 8.

As described above, in this embodiment, the fixing member 47 constituting a part of the frame of the two-sided conveyance unit 8 is fixed to the movable guide 45*b* of the slider 45 of the apparatus main body 2 with the screws 48, and the guide end 44*a* of the joining guide 44 is fixed to the fixing member 47 with screws 49. Thus, even a rigid (stiff) paper sheet abuts the joining guide 44, the joining guide 44 is not deformed to bend. Therefore, the paper sheet that is conveyed in the fourth conveying path L4 to the first conveying path L1 is guided by the joining guide 44 and is sent into the first conveying path L1 smoothly and accurately. In addition, when an image is formed on the second side of the paper sheet, the optical axis does not vary so that high quality two-sided images are obtained stably.

Next, details of the lower conveyance guide 8B of the two-sided conveyance unit 8 will be described with reference to FIGS. 9 to 15.

Figure 9:
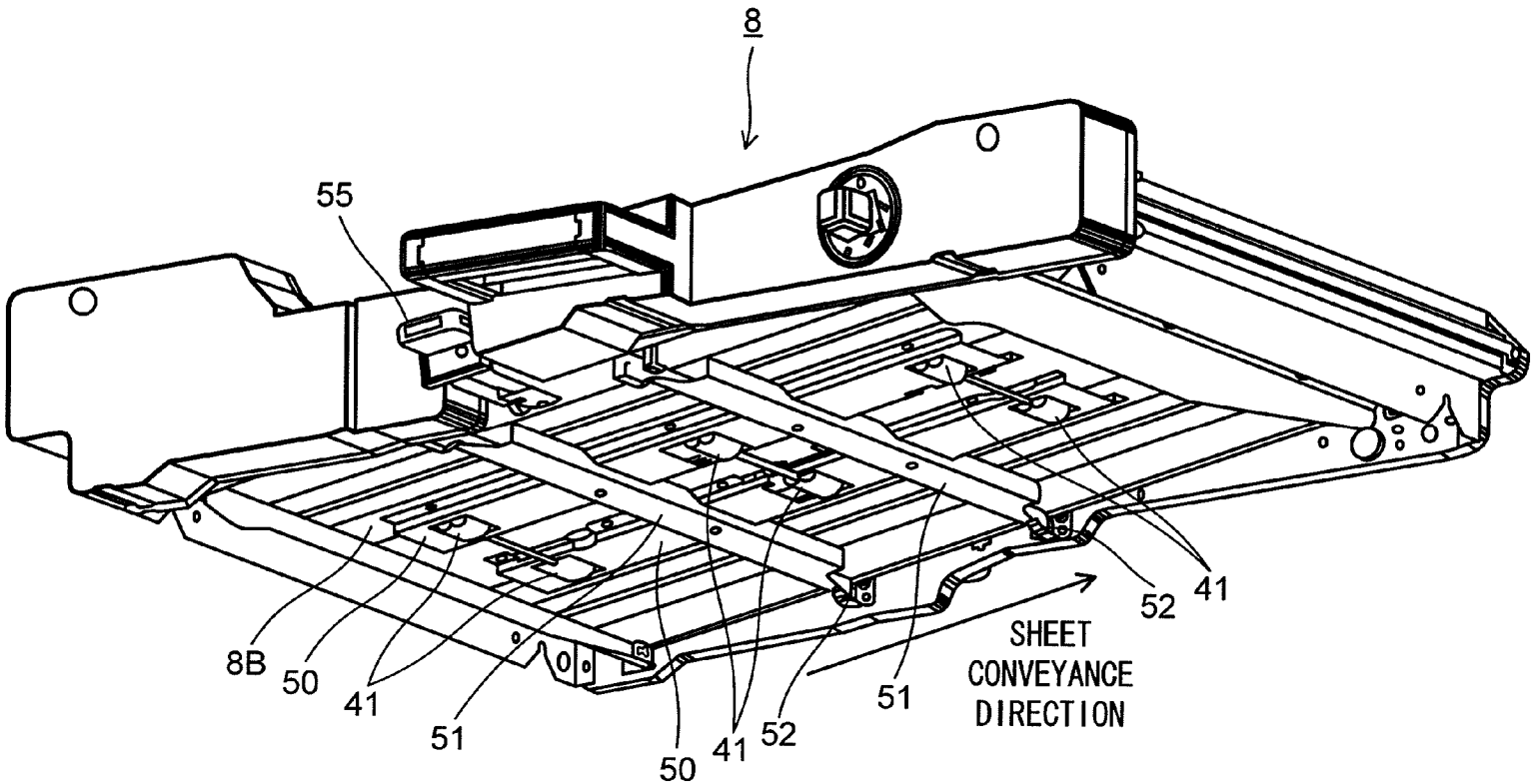
FIG. 9 is a perspective view of the two-sided conveyance unit viewed obliquely from the bottom.
Figure 10:
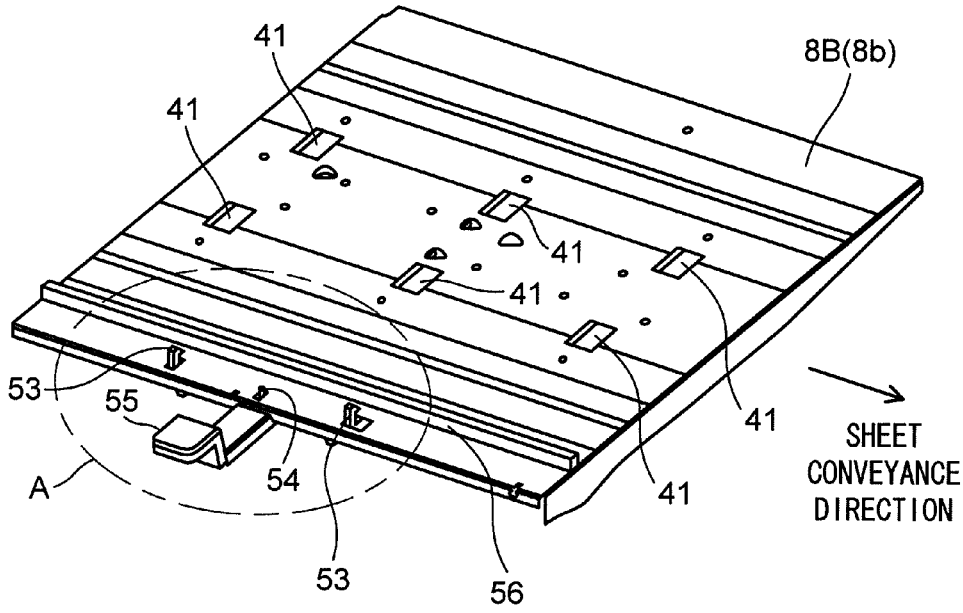
FIG. 10 is a perspective view of a conveyance guide of the two-sided conveyance unit viewed obliquely from the top.
Figure 11:
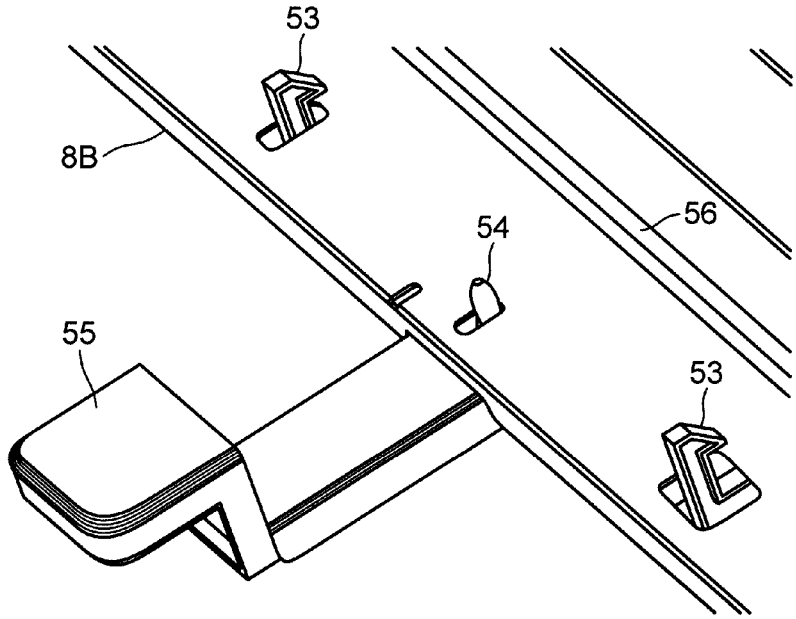
FIG. 11 is an enlarged detailed view of Part A in FIG. 10.
Figure 12:
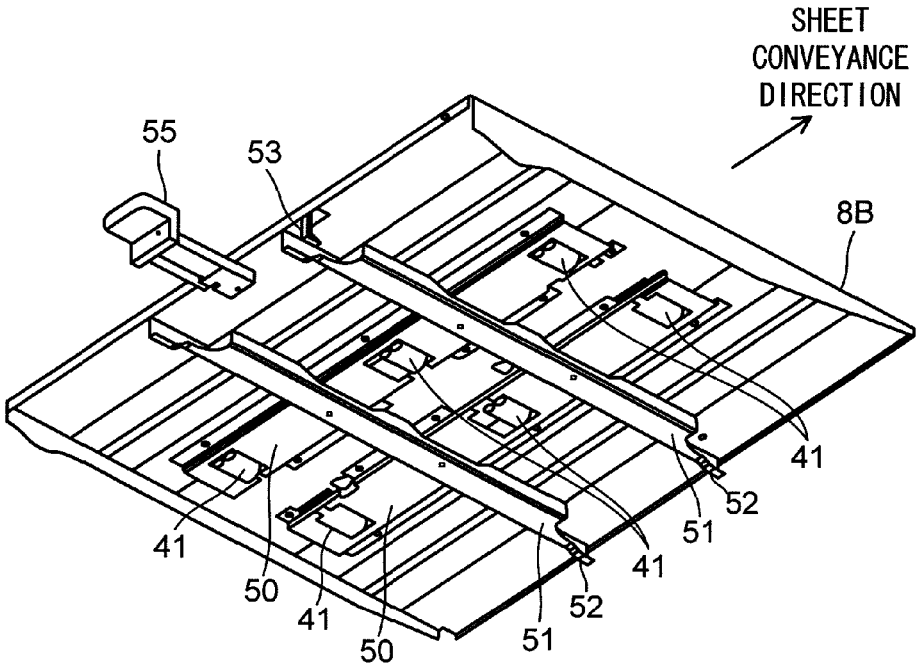
FIG. 12 is a perspective view of the conveyance guide viewed obliquely from the bottom.
Figure 13:
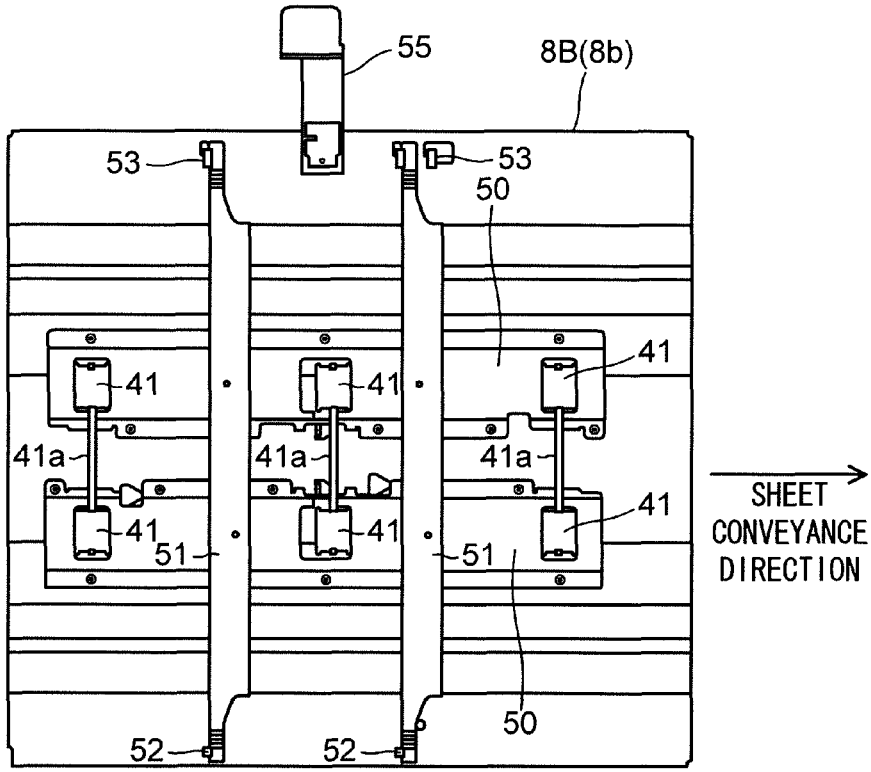
FIG. 13 is a bottom view of the conveyance guide.
Figure 14:
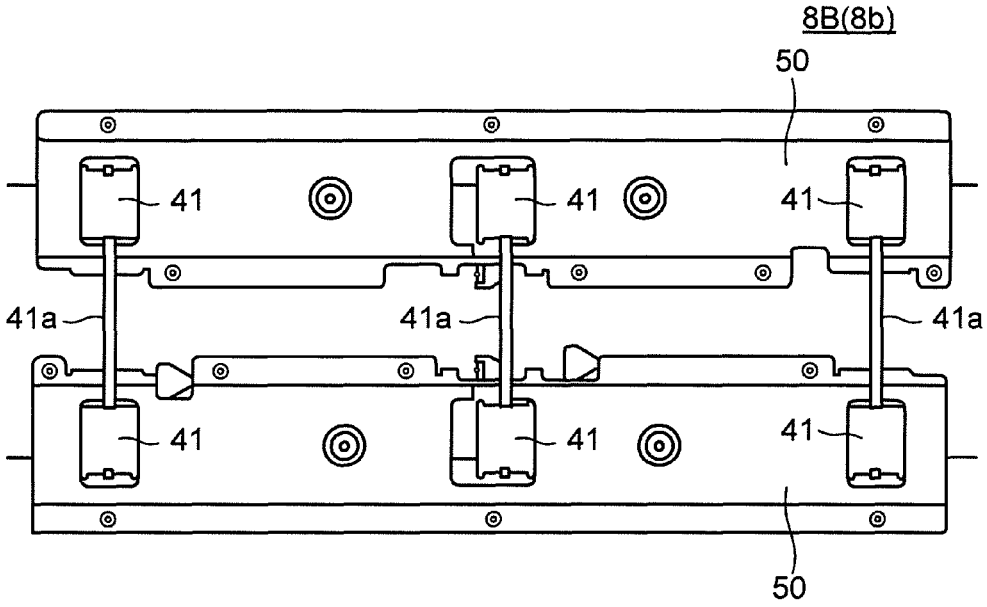
FIG. 14 is a bottom view of a reinforced place by a first reinforcing plate of the conveyance guide.
Figure 15:
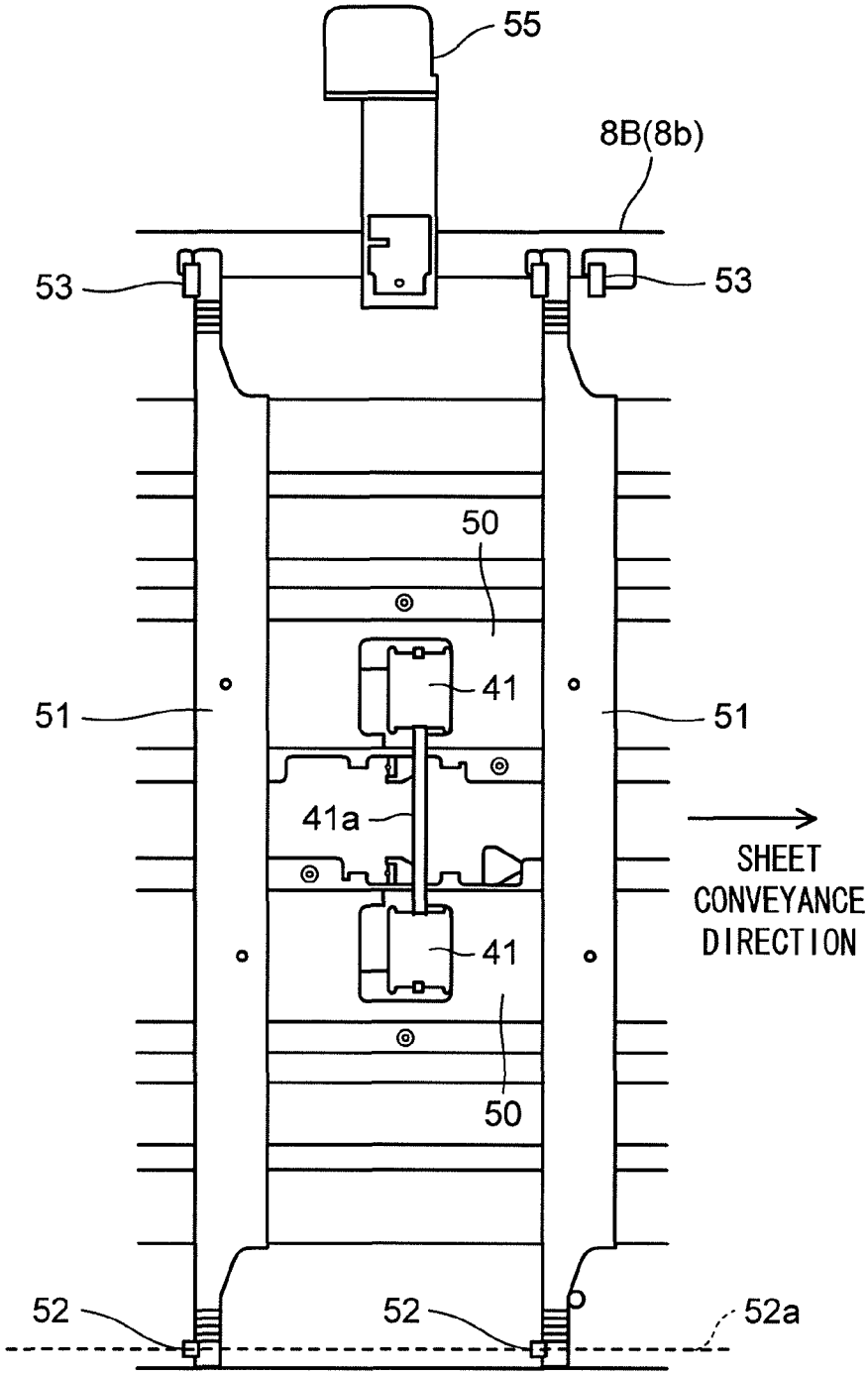
FIG. 15 is a bottom view of a reinforced place by a second reinforcing plate of the conveyance guide.

FIG. 9 is a perspective view of the two-sided conveyance unit viewed obliquely from the bottom, FIG. 10 is a perspective view of a conveyance guide of the two-sided conveyance unit viewed obliquely from the top, FIG. 11 is a enlarged detailed view of Part A in FIG. 10, FIG. 12 is a perspective view of the conveyance guide viewed obliquely from the bottom, FIG. 13 is a bottom view of the conveyance guide, FIG. 14 is a bottom view of a reinforced place by a first reinforcing plate of the conveyance guide, and FIG. 15 is a bottom view of a reinforced place by a second reinforcing plate of the conveyance guide.

The lower conveyance guide 8B is constituted of the above-described guide plate 8*b* made of a rectangular metal sheet member. This guide plate 8*b* is a single member like a flat sheet and forms the above-described linear path L4'. At the center in the width direction of the guide plate 8*b*, there are disposed three pairs of the left and right conveyance follower rollers 41 that are connected by a shaft 41*a* (see FIG. 13) at appropriate spaces along the sheet conveyance direction. The two left and right portions of the bottom surface of the guide plate 8*b* where the conveyance follower rollers 41 are disposed are reinforced by two left and right first reinforcing plates 50 (reinforcing members) that are disposed in parallel along the sheet conveyance direction. In addition, two portions on both sides of the center conveyance follower roller 41 in the sheet conveyance direction on the bottom surface of the lower conveyance guide 8B (guide plate 8*b*) are reinforced by two front and rear reinforcing plates 51 (reinforcing members) that are disposed in parallel so as to be perpendicular to the first reinforcing plates 50 (in the direction perpendicular to the sheet conveyance direction).

An open/close fulcrum 52 is provided to each back end of the two second reinforcing plates 51, and an open/close hook 53 is provided to each front end of the same. Two open/close fulcrum shafts 52*a* (see FIG. 15) passing through the two open/close fulcrums 52 are parallel to the sheet conveyance direction. In addition, on the front end of the lower conveyance guide 8B (guide plate 8*b*), a registration pin 54 is provided to stand between the two open/close hooks 53, and a handle 55 protruding to the front is disposed at the front of the registration pin 54. Therefore, the lower conveyance guide 8B (guide plate 8*b*) is attached in a rotatable manner about the open/close fulcrums 52, and the fourth conveying path L4 can be opened by pressing down the handle 55.

Specifically, if a conveyance error such as a jamming of a paper sheet occurs, the two-sided conveyance unit 8 is drawn out along the above-described sliders 45 to the front of the apparatus main body, a locked state of the lower conveyance guide 8B by the open/close hook 53 is released so that the front handle 55 is pressed down, and the lower conveyance guide 8B is opened downward about the back open/close fulcrums 52. Thus, a major part of the fourth conveying path L4 (at least the linear path L4') is opened. Thus, a paper sheet jamming at a position of the joining guide 44 or the sheet refeed roller 38 can easily be removed.

In addition, the lower conveyance guide 8B is reinforced by the first reinforcing plates 50 for the stiffness in the sheet conveyance direction, and is reinforced by the second reinforcing plates 51 for the stiffness in the direction perpendicular to the sheet conveyance direction. Therefore, warp or flexure in the directions does not occur, and a conveyance error of paper sheets due to the warp or flexure of the lower conveyance guide 8B can be prevented so that paper sheets can be conveyed correctly and stably.

Specifically, the lower conveyance guide 8B is like a flat sheet having an area larger than two A4 size paper sheets, but it is reinforced by the first reinforcing plates 50 and the second reinforcing plates 51. Since the paper sheet is conveyed straight, a large thrusting force does not act on the lower conveyance guide 8B during the conveying operation. Therefore, the lower conveyance guide 8B is not warped and can convey paper sheets appropriately.

Particularly in this embodiment, in the sheet conveyance direction of the lower conveyance guide 8B, the portions where the conveyance follower rollers 41 are disposed are reinforced by the first reinforcing plates 50. Therefore, when the lower conveyance guide 8B is pressed upward about the back open/close fulcrum 52 so as to close the fourth conveying path L4 after finishing a work against jamming, the conveyance follower roller 41 can securely be pressed to the conveyance roller 42 (see FIG. 1) by a predetermined pressure. In addition, the lower conveyance guide 8B is not deformed to bend by a reaction force from the conveyance roller 42 when the conveyance follower roller 41 presses the conveyance roller 42. Therefore, the paper sheet is secured retained between the conveyance follower roller 41 and the conveyance roller 42 and is conveyed normally, so that an occurrence of a conveyance error can be prevented.

In addition, in this embodiment, the open/close fulcrum 52 and the open/close hook 53 for the lower conveyance guide 8B is provided to the second reinforcing plate 51. Therefore, stiffnesses of the open/close fulcrum 52 and the open/close hook 53 are enhanced by the second reinforcing plate 51 so that deformations thereof can be prevented. Thus, the lower conveyance guide 8B can be opened or closed normally, and a closed state of the lower conveyance guide 8B by the open/close hook 53 can securely be locked. Therefore, the conveyance follower roller 41 is retained securely at a predetermined nip position in the closed state of the lower conveyance guide 8B.

In addition, as illustrated in FIG. 10, the lower conveyance guide 8B (guide plate 8*b*) is provided with a protrusion 56 (rib) that is formed for preventing a paper sheet from dropping off. This protrusion 56 is disposed at a front of a sheet conveying region of the guide plate 8*b*, protrudes from the sheet conveying surface toward the upper conveyance guide 8A, and extends along the sheet conveyance direction. Thus, when the lower conveyance guide 8B is opened, the protrusion 56 can prevent a paper sheet positioned in the fourth conveying path L4 (linear path L4') from dropping off. It can be said that the protrusion 56 is disposed at a downward side of a sheet conveying region of the one of the conveyance guides (the guide plate 8*b*) when the conveyance guide rotates.

Note that this embodiment describes the case where the present invention is applied to a multifunction apparatus, but it is of course possible to apply the present invention to a copier, a printer, a facsimile or the like as a single unit.

The image forming apparatus of this embodiment described above can also be expressed as follows and has the following effects consequently.

The image forming apparatus of this embodiment includes: a sheet storage portion for housing paper sheets; an image forming portion for forming images on a paper sheet fed from the sheet storage portion; a sheet ejector for ejecting paper sheets with images formed on one side or on both sides by the image forming portion; a sheet-reversing unit for reversing sides of the paper sheet with images formed on one side by the image forming portion; a first conveying path from the sheet storage portion to the image forming portion; a second conveying path from the image forming portion to the sheet ejector; a third conveying path branching from the second conveying path so as to reach the sheet-reversing unit; a fourth conveying path extending from the sheet-reversing unit so as to join the first conveying path; and a two-sided conveyance unit having the sheet-reversing unit and the fourth conveying path. Further, the fourth conveying path includes a linear path formed between two conveyance guides constituting the two-sided conveyance unit (the upper conveyance guide and the lower conveyance guide), the two-sided conveyance unit is supported in a slidable manner along a slider provided to an apparatus main body, and one of the two conveyance guides (the lower conveyance guide) is made of a flat guide plate forming the linear path and is supported in such a manner that it can be opened or closed with respect to the other conveyance guide.

In this way, since the fourth conveying path includes the linear path formed between the two conveyance guides constituting the two-sided conveyance unit, a paper sheet can be in the standby state in the linear path of the fourth conveying path when the two-sided printing is performed on a plurality of paper sheets. Thus, it is possible to prevent a malfunction such as curling of the paper sheet in the standby state. In addition, since the conveying path is linear in the linear path, conveyance performance of paper sheets can be improved.

In addition, the two-sided conveyance unit is slidable (can be drawn out), and one of the conveyance guides (the lower conveyance guide or the guide plate) can be opened or closed with respect to the other conveyance guide. Thus, even if jamming occurs in the two-sided conveyance path, a jammed paper sheet can be removed only by opening one of the conveyance guides after sliding the two-sided conveyance unit to the front, which makes the work easier. Further, since one of the conveyance guides is made of the guide plate that is a single flat member having a simple shape and a simple structure, it is advantageous in cost (cost can be reduced).

In addition, the open/close fulcrum shaft passing through the open/close fulcrum of the one of the conveyance guides (lower conveyance guide) is parallel to the sheet conveyance direction, and the guide front of the one of the conveyance guides rotates downward about the open/close fulcrum shaft. Namely, the downstream side of the guide plate (one of the conveyance guides) in drawing out direction rotates downward about the open/close fulcrum shaft. Thus, it is easy to open the front side of the entire conveyance path so as to remove a jammed paper sheet in the conveyance path.

In addition, the image forming apparatus of this embodiment includes: a sheet storage portion for housing paper sheets; an image forming portion for forming images on a paper sheet fed from the sheet storage portion; a sheet ejector for ejecting paper sheets with images formed on one side or on both sides by the image forming portion; a sheet-reversing unit for reversing sides of the paper sheet with images formed on one side by the image forming portion; a first conveying path from the sheet storage portion to the image forming portion; a second conveying path from the image forming portion to the sheet ejector; a third conveying path branching from the second conveying path so as to reach the sheet-reversing unit; a fourth conveying path extending from the sheet-reversing unit so as to join the first conveying path; and a two-sided conveyance unit having a joining guide disposed at a joining portion of the fourth conveying path with the first conveying path, the sheet-reversing unit, and the fourth conveying path. The two-sided conveyance unit is supported in a slidable manner along a slider provided to an apparatus main body, a fixing member constituting a part of the frame of the two-sided conveyance unit is fixed to the slider, and a guide end of the joining guide is fixed to the fixing member.

With this structure, since the fixing member constituting a part of the frame of the two-sided conveyance unit is fixed to the slider provided to the apparatus main body and the guide end of the joining guide is fixed to the fixing member, even if a paper sheet having high stiffness abuts the joining guide, the joining guide is not deformed to bend. Thus, a paper sheet can be guided by the joining guide and is conveyed smoothly and precisely to the first conveying path. When images are formed on the second side (back side thereof), the optical axis is not varied so that the two-sided image with high quality can be obtained stably.

Further, it can be said that the guide end of the joining guide is fixed to the movable guide of the slider via the fixing member constituting a part of the frame of the two-sided conveyance unit in the image forming apparatus of this embodiment. Thus, the same effect as described above can be obtained.

In addition, the image forming apparatus of this embodiment has the fourth conveying path that is formed substantially in a linear shape, and the joining guide has a shape including the linear portion (linear guide portion) extending along the sheet conveyance direction on the extension line of the fourth conveying path and the curved portion (curved guide portion) that is adjacent to the downstream side of the linear portion in the sheet conveyance direction and is curved in the direction to approach the sheet conveyance direction of the first conveying path.

With the structure described above, since the fourth conveying path is linear, the paper sheet is conveyed in the fourth conveying path smoothly and accurately. In addition, since the linear portion is provided to the joining guide so as to extends along the extension line of the fourth conveying path on the downstream side in the sheet conveyance direction, the paper sheet can smoothly be conveyed to the joining guide. Further, since the joining guide is provided with the curved portion that is curved in the direction to approach the conveyance direction of the first conveying path on the downstream side of the linear portion in the sheet conveyance direction, the paper sheet is conveyed from the linear portion along the curve of the curved portion so as to join the first conveying path. Therefore, even a paper sheet having high stiffness can be conveyed to the first conveying path smoothly and accurately.

Further, in the image forming apparatus of this embodiment, the fourth conveying path that is adjacent to the upstream side of the joining guide in the sheet conveyance direction and extends linearly is constituted of the conveyance guides that are opposed to each other. The conveyance guides have guide surfaces opposed to each other with predetermined distance and one of the pair of conveyance rollers for conveying the paper sheet. In addition, in the state where the two-sided conveyance unit is drawn out from the apparatus main body, one of the conveyance guides moves in the direction to separate from the other conveyance guide so that the fourth conveying path is opened.

With the above-described structure, since the one of the conveyance guides that are opposed to each other so as to constitute the fourth conveying path extending linearly on the upstream side in the sheet conveyance direction of the joining guide can move in the direction to separate from the other conveyance guide together with the one of the conveyance rollers for conveying the paper sheet, in the state where the two-sided conveyance unit is drawn out from the apparatus main body, a paper sheet that is jammed in the joining guide can easily be removed. In addition, the joining guide is not deformed to bend, and a large force is not exerted on the movable conveyance guide. Therefore, even if the conveyance guide is large, it is not deformed to bend so that a paper sheet that is jammed in a place other than the joining guide can also be removed easily.

In addition, the image forming apparatus of this embodiment includes: a sheet storage portion for housing paper sheets; an image forming portion for forming images on a paper sheet fed from the sheet storage portion; a sheet ejector for ejecting paper sheets with images formed on one side or on both sides by the image forming portion; a sheet-reversing unit for reversing sides of the paper sheet with images formed on one side by the image forming portion; a first conveying path from the sheet storage portion to the image forming portion; a second conveying path from the image forming portion to the sheet ejector; a third conveying path branching from the second conveying path so as to reach the sheet-reversing unit; a fourth conveying path extending from the sheet-reversing unit so as to join the first conveying path; and a conveyance guide which constitutes a part of the fourth conveying path and can open the fourth conveying path. Here, the conveyance guide is reinforced by a first reinforcing plate extending in the sheet conveyance direction and a second reinforcing plate that is perpendicular to the first reinforcing plate.

With the above-described structure, since the conveyance guide is reinforced by the first reinforcing plate extending in the sheet conveyance direction and the second reinforcing plate that is perpendicular to the first reinforcing plate, stiffness of the conveyance guide is enhanced so that warp or flexure of the conveyance guide is prevented. Thus, a conveyance error of paper sheets due to the warp or flexure of the conveyance guide can be prevented so that paper sheets can be conveyed normally and stably.

In addition, in the image forming apparatus of this embodiment, a plurality of conveyance follower roller portions of the conveyance guide that are arranged in the sheet conveyance direction are reinforced by the first reinforcing plate. Note that the conveyance follower roller portions mean the portions of the conveyance guide where the plurality of conveyance follower rollers are arranged (portions around the holes where the plurality of conveyance follower rollers are arranged).

Since the plurality of conveyance follower roller portions of the conveyance guide in the sheet conveyance direction is reinforced by the first reinforcing plate, a pressing error of the conveyance follower roller does not occur. The conveyance follower roller always conveys paper sheet appropriately so that an occurrence of a conveyance error can be prevented. Thus, in the closed state of the conveyance guide, the conveyance follower roller can securely be retained at a predetermined nip position.

Further, in the image forming apparatus of this embodiment, the second reinforcing plate is provided with the open/close fulcrum and the open/close hook of the conveyance guide.

Since the second reinforcing plate is provided with the open/close fulcrum and the open/close hook of the conveyance guide, stiffnesses of the open/close fulcrum and the open/close hook of the conveyance guide are enhanced by the second reinforcing plate so that a deformation thereof can be prevented. Thus, the conveyance guide can normally be opened or closed, and the closed state of the conveyance guide by the open/close hook is securely locked. Thus, in the closed state of the conveyance guide, the conveyance follower roller can securely be retained at a predetermined nip position.

In addition, since the open/close fulcrum is formed on one end portion of the second reinforcing plate, and the open/close hook is formed on the other end portion of the second reinforcing plate, it is possible to realize the structure securely in which the conveyance guide is opened or closed about the open/close fulcrum.

It is apparent from the above description that various modifications and variations are possible with respect to the present invention. Therefore, it should be interpreted that the present invention is not limited to the concrete description but can be embodied in the scope of the attached claims.

What is claimed is:

1. An image forming apparatus comprising:

a sheet storage portion for housing paper sheets;

an image forming portion for forming images on a paper sheet fed from the sheet storage portion;

a sheet ejector for ejecting paper sheets with images formed on one side or on both sides by the image forming portion;

a sheet-reversing unit for reversing sides of the paper sheet with images formed on one side by the image forming portion;

a first conveying path from the sheet storage portion to the image forming portion;

a second conveying path from the image forming portion to the sheet ejector;

a third conveying path branching from the second conveying path so as to reach the sheet-reversing unit;

a fourth conveying path extending from the sheet-reversing unit so as to join the first conveying path; and a two-sided conveyance unit having the sheet-reversing unit and the fourth conveying path, wherein the fourth conveying path includes a linear path formed between two conveyance guides constituting the two-sided conveyance unit, the two-sided conveyance unit is supported in a slidable manner along a slider provided to an apparatus main body, one of the two conveyance guides is made of a flat guide plate forming the linear path and is supported in such a manner that it can be opened or closed with respect to the other conveyance guide, the two-sided conveyance unit further includes a reinforcing member which reinforces the said one of the conveyance guides, the reinforcing member has a first reinforcing plate extending in the sheet conveyance direction and a second reinforcing plate that is perpendicular to the first reinforcing plate, and the second reinforcing plate includes an open/close fulcrum and an open/close hook of the said one of the conveyance guides.

2. The image forming apparatus according to claim 1, wherein the said one of the conveyance guides includes a plurality of conveyance follower rollers arranged in the sheet conveyance direction, and the first reinforcing plate reinforces a portion of the said one of the conveyance guides where the plurality of conveyance follower rollers are arranged.

3. The image forming apparatus according to claim 1, wherein the open/close fulcrum is formed at one end of the second reinforcing plate, and the open/close hook is formed at the other end of the second reinforcing plate.

4. The image forming apparatus according to claim 1, wherein an open/close fulcrum shaft passing through the open/close fulcrum is parallel to the sheet conveyance direction, and the downstream side of the guide plate in a drawing out direction rotates downward about the open/close fulcrum shaft.

5. The image forming apparatus according to claim 4, wherein the said one of the conveyance guides further includes a protrusion for preventing a paper sheet from dropping off, and the protrusion is disposed at a rotating downwardly side of a sheet conveying region of the said one of the conveyance guides, protrudes from the sheet conveying surface, and extends along the sheet conveyance direction.

6. An image forming apparatus comprising:

a sheet storage portion for housing paper sheets;

an image forming portion for forming images on a paper sheet fed from the sheet storage portion;

a sheet ejector for ejecting paper sheets with images formed on one side or on both sides by the image forming portion;

a sheet-reversing unit for reversing sides of the paper sheet with images formed on one side by the image forming portion;

a first conveying path from the sheet storage portion to the image forming portion;

a second conveying path from the image forming portion to the sheet ejector;

a third conveying path branching from the second conveying path so as to reach the sheet-reversing unit;

a fourth conveying path extending from the sheet-reversing unit so as to join the first conveying path; and a two-sided conveyance unit having the sheet-reversing unit and the fourth conveying path, wherein the fourth conveying path includes a linear path formed between two conveyance guides constituting the two-sided conveyance unit, the two-sided conveyance unit is supported in a slidable manner along a slider provided to an apparatus main body, one of the two conveyance guides is made of a flat guide plate forming the linear path and is supported in such a manner that it can be opened or closed with respect to the other conveyance guide, the two-sided conveyance unit further includes a joining guide disposed at the joining portion of the fourth conveying path with the first conveying path, a fixing member constituting a part of a frame of the two-sided conveyance unit is fixed to the slider, a guide end of the joining guide is fixed to the fixing member, the slider includes a fixed guide attached to the apparatus main body, a movable guide attached to the two-sided conveyance unit, and a guide rail retained so that it can slide with respect to the fixed guide and the movable guide, and the guide end of the joining guide is fixed to the movable guide via the fixing member.

7. The image forming apparatus according to claim 6, wherein the joining guide includes a linear portion extending along the sheet conveyance direction on an extension line of the fourth conveying path, and a curved portion that is adjacent to the linear portion at the downstream side in the sheet conveyance direction and is curved in the direction approaching the sheet conveyance direction of the first conveying path.

8. The image forming apparatus according to claim 7, wherein the guide end of the joining guide is formed by bending the end portion of the curved portion opposite to the linear portion outward.

9. The image forming apparatus according to claim 6, wherein each of the conveyance guides includes guide surfaces opposed to each other with a predetermined distance and one of a pair of rollers for conveying the paper sheet, and in the state where the two-sided conveyance unit is drawn out from the apparatus main body, the said one of the conveyance guides moves in the direction to separate from the other conveyance guide, so that the linear path of the fourth conveying path is opened.

* * * * *